US008107872B2

(12) United States Patent
Ozaki et al.

(10) Patent No.: US 8,107,872 B2
(45) Date of Patent: Jan. 31, 2012

(54) IMAGE FORMING APPARATUS AND PROCESS CARTRIDGE

(75) Inventors: Naoyuki Ozaki, Ebina (JP); Hiroshi Nakai, Yokohama (JP); Masahide Yamashita, Tokyo (JP); Masato Iio, Yokohama (JP); Shinya Tanaka, Sagamihara (JP); Kunio Hasegawa, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 357 days.

(21) Appl. No.: 12/468,916

(22) Filed: May 20, 2009

(65) Prior Publication Data

US 2009/0304423 A1 Dec. 10, 2009

(30) Foreign Application Priority Data

Jun. 6, 2008 (JP) ..... 2008-149604

(51) Int. Cl.
*G03G 21/00* (2006.01)

(52) U.S. Cl. ..... 399/346; 399/350; 184/17

(58) Field of Classification Search ..... 399/50, 399/71, 168, 343, 346, 350; 184/14, 17, 184/99

See application file for complete search history.

(56) References Cited

U.S. PATENT DOCUMENTS

| | | | | |
|---|---|---|---|---|
| 2007/0242992 | A1* | 10/2007 | Watanabe et al. | 399/354 |
| 2007/0258743 | A1* | 11/2007 | Shakuto et al. | 399/346 |
| 2008/0089726 | A1 | 4/2008 | Hatakeyama et al. | |
| 2008/0118286 | A1 | 5/2008 | Yamashita et al. | |
| 2008/0138132 | A1 | 6/2008 | Yamashita et al. | |
| 2008/0226365 | A1 | 9/2008 | Hatakeyama et al. | |
| 2008/0253801 | A1 | 10/2008 | Hatakeyama et al. | |
| 2009/0003853 | A1 | 1/2009 | Hatakeyama et al. | |
| 2009/0016769 | A1 | 1/2009 | Hatakeyama et al. | |
| 2009/0028618 | A1 | 1/2009 | Kabata et al. | |

FOREIGN PATENT DOCUMENTS

| | | |
|---|---|---|
| JP | 2002-156877 | 5/2002 |
| JP | 2002-244516 | 8/2002 |
| JP | 2004-341480 | 12/2004 |
| JP | 2005-70276 | 3/2005 |
| JP | 2005-115311 | 4/2005 |
| JP | 2008-122869 | 5/2008 |

* cited by examiner

*Primary Examiner* — David Porta
*Assistant Examiner* — Benjamin Schmitt
(74) *Attorney, Agent, or Firm* — Dickstein Shapiro LLP

(57) ABSTRACT

An image forming apparatus including a charging unit configured to charge a surface of an image bearing member utilizing discharge generated by applying a voltage containing an alternating current component to a charging member disposed in contact with or close to the image bearing member, so that a latent electrostatic image is formed on the image bearing member; a developing unit configured to develop the latent electrostatic image formed on the image bearing member using a toner; a cleaning unit configured to clean the surface of the image bearing member using a blade; a protecting agent applying unit configured to rub and scrape a protecting agent by a brush roller and apply the protecting agent to the surface of the image bearing member; and a protecting agent charging member configured to charge the protecting agent, the member being disposed between the protecting agent applying unit and the charging unit.

6 Claims, 4 Drawing Sheets

IMAGE FORMING APPARATUS AND PROCESS CARTRIDGE

BACKGROUND OF THE INVENTION

1. Field of the Invention

The present invention relates to an image forming apparatus such as a complex machine equipped with at least one of a copier, a printer, a facsimile and a plotter, more specifically relates to an image forming apparatus using a process of applying or attaching a protecting agent to the surface of an image bearing member; and a process cartridge detachably mounted to the main body of the image forming apparatus.

2. Description of the Related Art

Conventionally, an image forming apparatus employing an electrophotographic process has a charging unit for charging the surface of a photoconductor as an image bearing member. As one of charging methods used with a charging unit, there is a charging method based on close-contact discharging, in which a charging member is placed in contact or non-contact with the surface of a photoconductor, and the surface of the photoconductor is charged by close-contact discharging.

In recent years, with increasing demands for higher quality of images, and downsizing of apparatuses, charging devices are more and more required to contribute to higher quality of images and the downsizing thereof. In view of the requirements, a charging device employing close-contact discharging, in which a charging member is placed and used in contact with or close to an image bearing member, is effective because it needs not to be placed in a large-size charging device.

In a charging device employing the close-contact charging (discharging), it is hard to uniformly charge the surface of a photoconductor due to a nonuniform contact between the charging member and the photoconductor or due to an amount of fluctuation of a gap between the charging member and the photoconductor in the case where noncontact charging method is employed. To overcome the drawback, recently, an AC-superimposed discharging method has been often used in which a direct current (DC) component is superimposed on an alternating current (AC) component.

The close-contact charging method in which an AC component is superimposed on a DC component can be said as an extremely advantageous technique in terms of downsizing of apparatus, formation of higher quality of images and giving high-durability of photoconductor, because a charging member and a photoconductor can be placed in noncontact manner while keeping the uniformity of charging.

Such a charging method in which an AC component is superimposed on a DC component, however, activates a photoconductor surface to increase an adhesion force between the photoconductor surface and a toner, and thus from the viewpoint of the cleanability, it is disadvantageous in the configuration. Moreover, since toner particles are made to be small in diameter and to be more spherical to obtain a high quality image, the cleanability tends to further degrade.

Furthermore, recent studies reveal that since use of a charging method based on close-contact discharging tends to cause deterioration of a photoconductor surface since the photoconductor surface and peripheral portions are concentrically discharged. The deterioration of the photoconductor surface due to close-contact discharging occurs even in the absence of members which make contact with the photoconductor, unlike deterioration due to mechanical abrasion.

Under application of an AC voltage, such a problem with a degradation of cleanability and abrasion resistance of the photoconductor is conspicuous. Therefore, there is a great need to satisfy both the cleanability and the abrasion resistance.

As a means for solving the problem, there are the following configurations disclosed: a protecting agent applying unit for applying a protecting agent onto a photoconductor is provided to reduce mechanical abrasion of the photoconductor (see Japanese Patent Application Laid-Open (JP-A) Nos. 2002-156877 and 2002-244516); a protecting agent applying unit for protecting the surface of a photoconductor against chemical deterioration (see JP-A Nos. 2004-341480 and 2005-115311); and a unit for applying a solid protecting agent, such as zinc stearate, to the surface of a photoconductor.

When a protecting agent is used, the photoconductor is smeared with the protecting agent. To solve this problem, there is known a method for adjusting the applied amount of a protecting agent.

JP-A No. 2005-070276 discloses a configuration of an image forming apparatus in which there are provided a protecting agent-coating mechanism and a unit for forming the applied protecting agent into a thin layer of uniform thickness, at the downstream of a cleaning unit.

These units exhibit an excellent effect of satisfying both the cleanability and the abrasion resistance of a photoconductor, but a new problem arises that the protecting agent itself passes through a cleaning blade and is attached to the charging member.

If a protecting agent that has passed through the cleaning blade is attached to and accumulated on the charging member, the protecting agent shows up as an undesirable abnormal image such as black streaks.

In order to solve the problem with abnormal images such as black streaks, the present applicant proposes in JP-A No. 2008-122869, a protecting agent removing unit configured to remove a powdery lubricant so as to prolong the life span of a charging member.

However, in this method, the protecting agent removing unit becomes gradually smeared with time, and the effect of removing the protecting agent is reduced, and this method has not achieved in sufficiently prolonging the life span of a charging member.

In the form of a process cartridge, there is a problem that although photoconductor itself has a long life, it is replaced with a new one in an early stage of life due to the smeared charging member. Accordingly, there is still room for research on units for prolonging the life span of the whole members disposed around a photoconductor.

BRIEF SUMMARY OF THE INVENTION

In view of the above mentioned situation, the present invention has an object to provide an image forming apparatus and a process cartridge having a simple configuration, allowing the downsizing thereof and low-cost production, whereby abrasion of a photoconductor can be prevented, the cleanability of the photoconductor can be maintained even under application of an AC voltage, longer lives of whole members disposed around the photoconductor can be achieved by preventing a charging member from smearing, and images excellent in quality can be output over a long period of time.

The present inventors have repeatedly observed the state of presence of a protecting agent on a photoconductor, and as a result, and the observation revealed that most of protecting agent immediately after scraped with the brush exists in the form of powder, and this powdery protecting agent moves onto the charging member by the effect of an electric field, causing smear.

In brief, since the polarity of particles of the powdery protecting agent differs from each other, the protecting agent particles having opposite polarity to the polarity of the photoconductor are attracted onto the charging member by the effect of an electric field, and attached thereto. The present invention has been accomplished based on the experimental fact.

Means for solving the above problems is as follows:

<1> An image forming apparatus including: a charging unit configured to charge a surface of an image bearing member utilizing discharge generated by applying a voltage containing an alternating current component to a charging member disposed in contact with or close to the image bearing member, so that a latent electrostatic image is formed on the image bearing member, a developing unit configured to develop the latent electrostatic image formed on the image bearing member using a toner, a cleaning unit configured to clean the surface of the image bearing member using a blade, a protecting agent applying unit configured to rub and scrape a protecting agent by a brush roller and apply the protecting agent to the surface of the image bearing member, and a protecting agent charging member configured to charge the protecting agent, the protecting agent charging member being disposed between the protecting agent applying unit and the charging unit.

<2> The image forming apparatus according to <1>, wherein the protecting agent charging member is a conductive blade.

<3> The image forming apparatus according to <2>, wherein the conductive blade is made of an elastic member.

<4> The image forming apparatus according to <2> or <3>, wherein the conductive blade is contacted with the image bearing member in a direction counter to the rotational direction of the image bearing member.

<5> The image forming apparatus according to any one of <1> to <4>, wherein the protecting agent contains a fatty acid metal salt.

<6> The image forming apparatus according to <5>, wherein the fatty acid metal salt is zinc stearate.

<7> A process cartridge detachably mounted on a main body of an image forming apparatus, the process cartridge including as an integral unit: the charging unit, the image bearing member, the developing unit, the cleaning unit, the protecting agent applying unit, and the protecting agent charging unit each according to any one of <1> to <6>.

According to the present invention, it is possible to prevent a powdery protecting agent that has been applied onto the surface of an image bearing member from adhering onto a charging member due to the effect of an electric field, and thus the surface of the charging member can be prevented from smearing with high accuracy, and an excellent image having no black streaks can be maintained for a long period of time.

DETAILED DESCRIPTION OF THE INVENTION

Hereinafter, embodiments according to the present invention will be explained with reference to the drawings.

Figure 4:
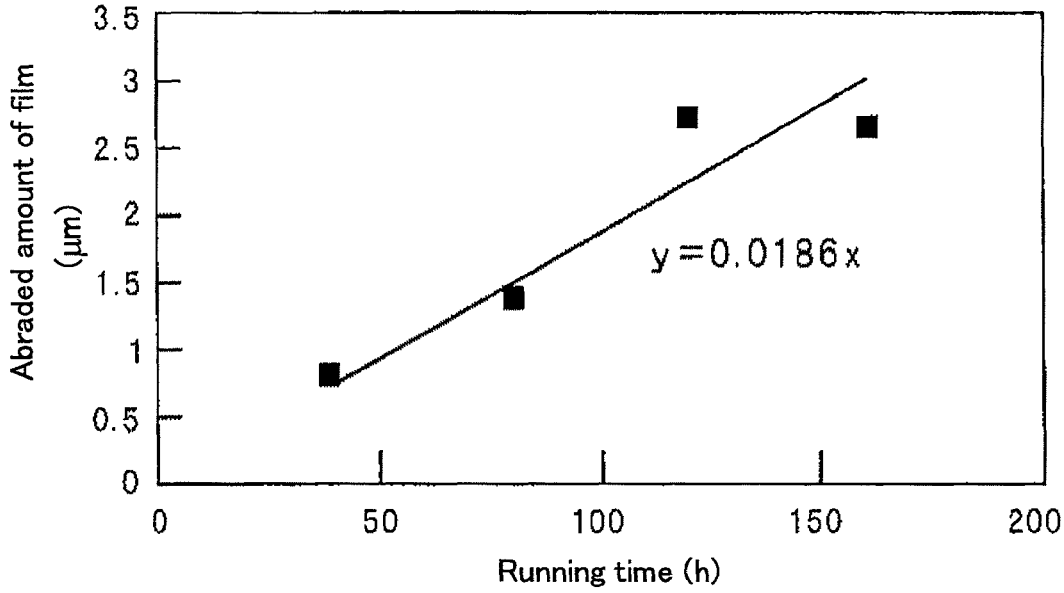
FIG. 4 is an experimental graph showing an abraded amount of a film of a photoconductor by close-contact discharging.
Figure 5A:
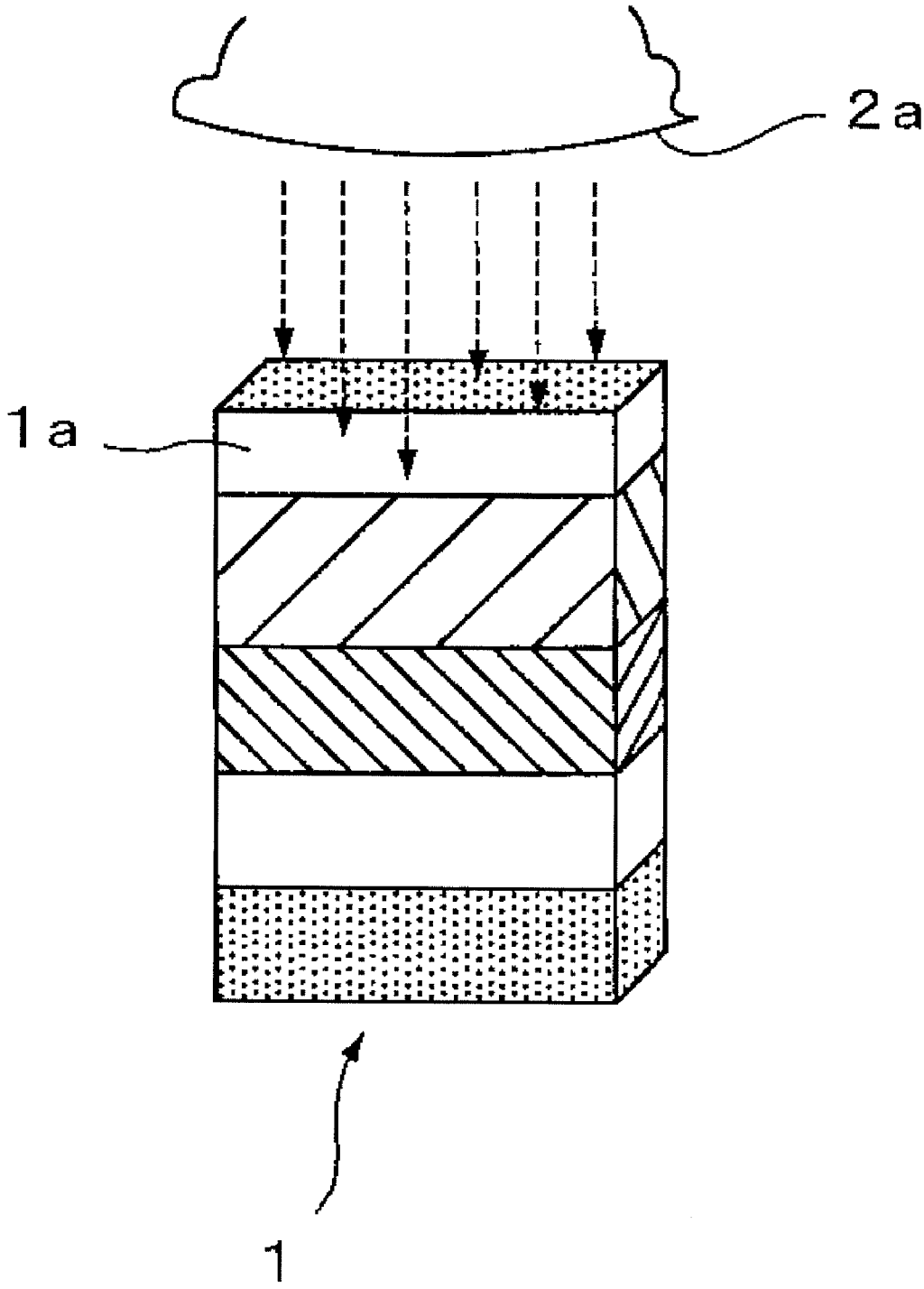
FIG. 5A is a schematic diagram for explaining the mechanism of reduction in the film thickness of the photoconductor.
Figure 5B:
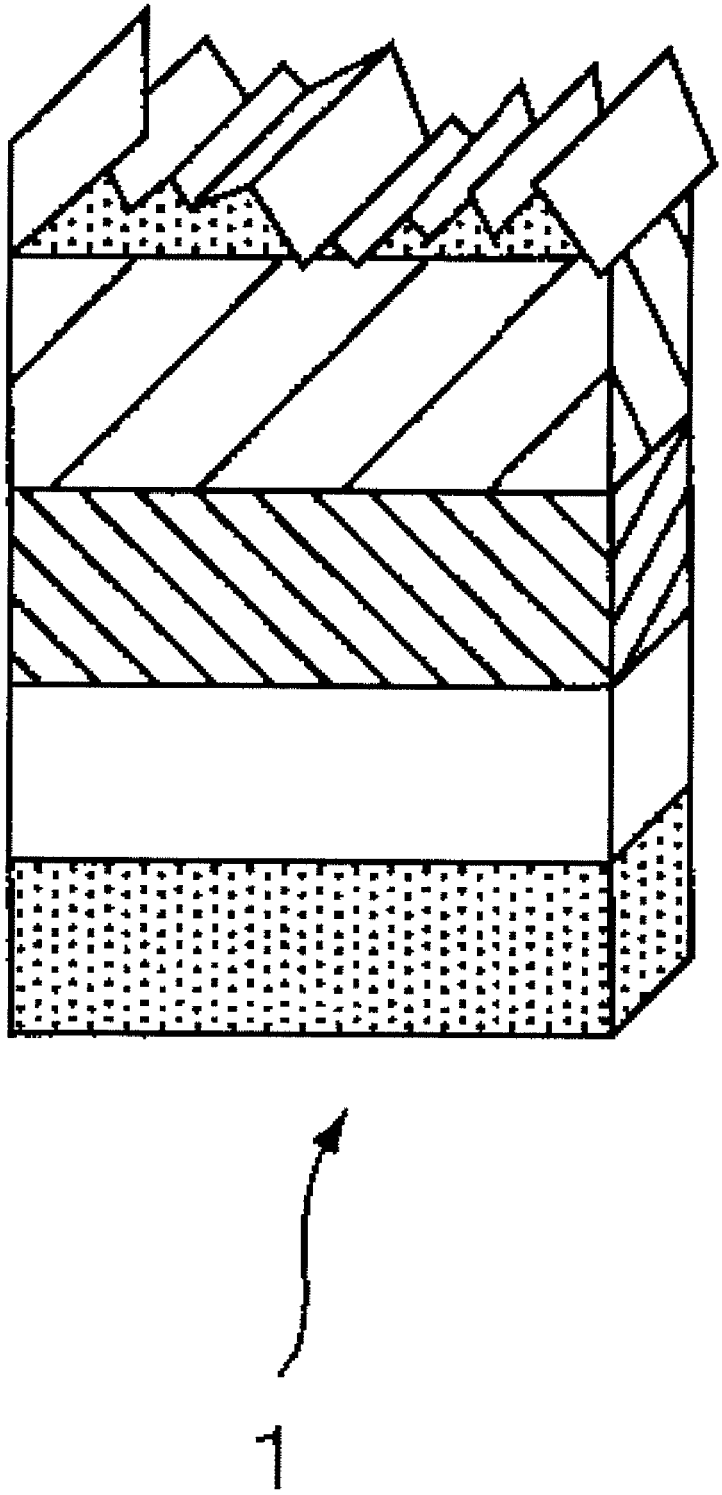
FIG. 5B is a schematic diagram for explaining the mechanism of reduction in the film thickness of the photoconductor.

Firstly, with reference to FIG. 4 and FIGS. 5A and 5B, the following explains, on the basis of the experimental results obtained by the present inventors, phenomena of deterioration of a photoconductor surface due to close-contact discharging which have been caused even in the absence of members in contact with the photoconductor.

FIG. 4 shows measurement results of changes in film thickness of a surface of a photoconductor when a charging experiment was continuously carried out for about 150 hours in which a charging member alone was disposed closely to the photoconductor surface in a noncontact manner.

The photoconductor used herein was an organic photoconductor having, on its surface, a charge transporting layer containing polycarbonate as a binder resin. In the experiment, the photoconductor surface was charged using a noncontact charge roller in which an AC bias was superimposed on a DC bias was applied, after all the members in contact with the photoconductor had been removed.

As a result, the film thickness of photoconductor surface was found to be gradually reduced. Although the mechanism of the reduction in film thickness is now under study and is not clear, however, as a result of an analysis on the photoconductor having a reduced film thickness, carboxylic acids and the like were found which were considered to be generated by decomposition of the polycarbonate constituting the photoconductor. Based on this finding, the mechanism of reduction in film thickness is considered as follows.

FIGS. 5A to 5B are explanatory diagrams showing a state of a photoconductor surface when the surface of photoconductor 1 deteriorated due to close-contact discharging, with a charge roller 2*a* being placed to face the photoconductor surface with a minute gap.

When close contact discharging is performed in a discharge region on the photoconductor surface, a charge transporting layer 1*a* is irradiated with the energy of particles (i.e., ozone, electrons, excited molecules, ions and plasmas) generated by the discharge. This energy is resonated with and absorbed into a binding energy of molecules constituting the photoconductor surface, and as shown in FIG. 5A, the charge transporting layer 1*a* undergoes chemical deterioration such as a reduction of molecular weight due to cutting-off of chains of resin molecules, a decrease in degree of entanglement of polymer chains, evaporation of the resin, and the like.

It is considered that due to such chemical deterioration of the photoconductor caused by close-contact discharging, the film thickness of the charge transporting layer 1*a* of the photoconductor surface is gradually reduced (see FIG. 5B).

When the photoconductor surface is mechanically rubbed with a cleaning blade, abrasion of the photoconductor is further accelerated.

Embodiments of the present invention will be described with reference to FIGS. 1 to 3.

Figure 1:
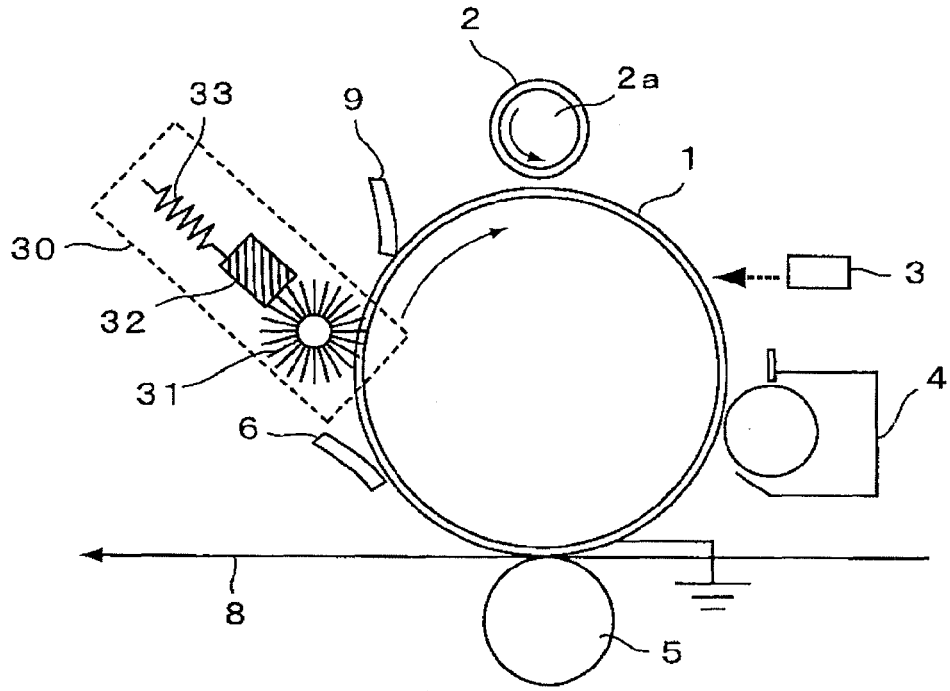
FIG. 1 is a structural diagram showing an essential part of the image forming apparatus according to an embodiment of the present invention.

FIG. 1 shows one example of an image forming apparatus having a configuration common to the Examples described later. This image forming apparatus is equipped with a photoconductor 1 as an image bearing member serving as an organic photoconductor.

The photoconductor 1 is driven to rotate by a drive unit (not shown) and its surface is charged with a predetermined polarity by a charge roller 2*a* of a charging device 2 as a charging unit employing close-contact charging. The charged surface of the photoconductor 1 is exposed by an exposing device 3, and a latent electrostatic image corresponding to the image information is formed.

This latent electrostatic image is developed using a toner as a developer which has been supplied on the surface of the photoconductor 1 from a developing device 4 as a developing unit, and visualized as a toner image.

Meanwhile, a transfer paper as a recording medium is fed from a paper feeding unit (not shown) toward the photoconductor 1. The toner image formed on the photoconductor 1 is transferred onto the transfer paper by a transfer device 5 placed to face the photoconductor 1. The transfer paper carrying on its surface the toner image is separated from the photoconductor 1 and then conveyed along a transfer paper conveying pass 8 to a fixing device (not shown), and the toner image is fixed.

Untransferred toner which is remaining on the photoconductor 1 after the transfer of the toner image onto the transfer paper is removed from the photoconductor 1 by a cleaning blade 6 as a cleaning unit. In this way, the photoconductor 1 is repeatedly used. Note that the image forming apparatus of the present embodiment includes a protecting agent coating device 30 as a protecting agent applying unit, and a protecting agent charging member 9, which will be described later.

Figure 2:
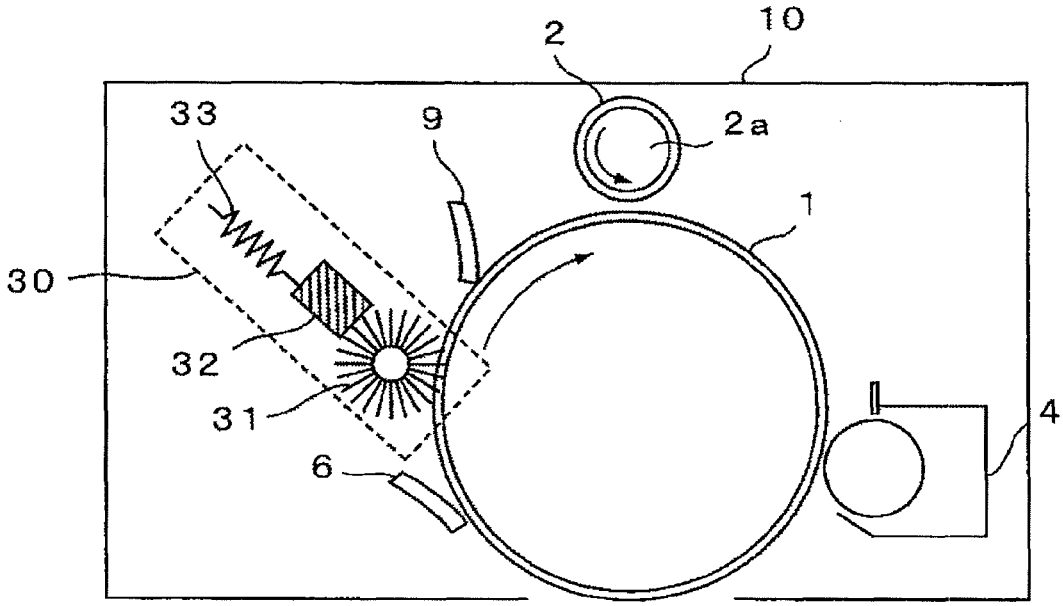
FIG. 2 is a schematic block diagram generally showing a process cartridge.

In the image forming apparatus of the present embodiment, the photoconductor 1, the charge roller 2*a* as a charging member, a developing device 4, a cleaning device (cleaning blade 6), a protecting agent coating device 30, and a protecting agent charging member 9 are integrally structured into one unit in a casing, as shown in FIG. 2, as a process cartridge 10 which is detachably mounted to a main body of an image forming apparatus (not shown).

Since such a process cartridge 10 is replaced as one unit, the amount of the protecting agent contained in the protecting agent coating device 30 and an initial film thickness of the photoconductor 1 and the like can easily be set to each appropriate value. Therefore, the process cartridge is suitably used for an image forming apparatus of the present invention.

Next, a charging device 2 to be used in the image forming apparatus of the present embodiment will be explained. The charging device 2 charges a surface of the photoconductor 1 by close-contact discharging. Methods of charging the photoconductor 1 by close-contact discharging are classified into two types of charging: a contact charging method in which a charge roller 2*a*, which is a rotatable roller charging member, is disposed in contact with the photoconductor 1, and a noncontact charging method in which the charge roller 2*a* is disposed in noncontact with the photoconductor 1. The present embodiment uses the noncontact charging method.

The present invention can also employ a contact charging method. In a contact charging method, it is preferable to use an elastic member which is capable of improving the contact property with a photoconductor surface and does not give a mechanical stress to the photoconductor 1.

However, when an elastic member is used, a nip width for the charge becomes wider and a protecting agent attaches more easily to the charge roller. Thus, to attain higher durability, use of the noncontact charging method is more advantageous.

In the present embodiment, the noncontact charging method is employed in which a charge roller 2*a* is disposed so as to face at least an image forming region of the photoconductor surface with a predetermined charge gap.

Figure 3:
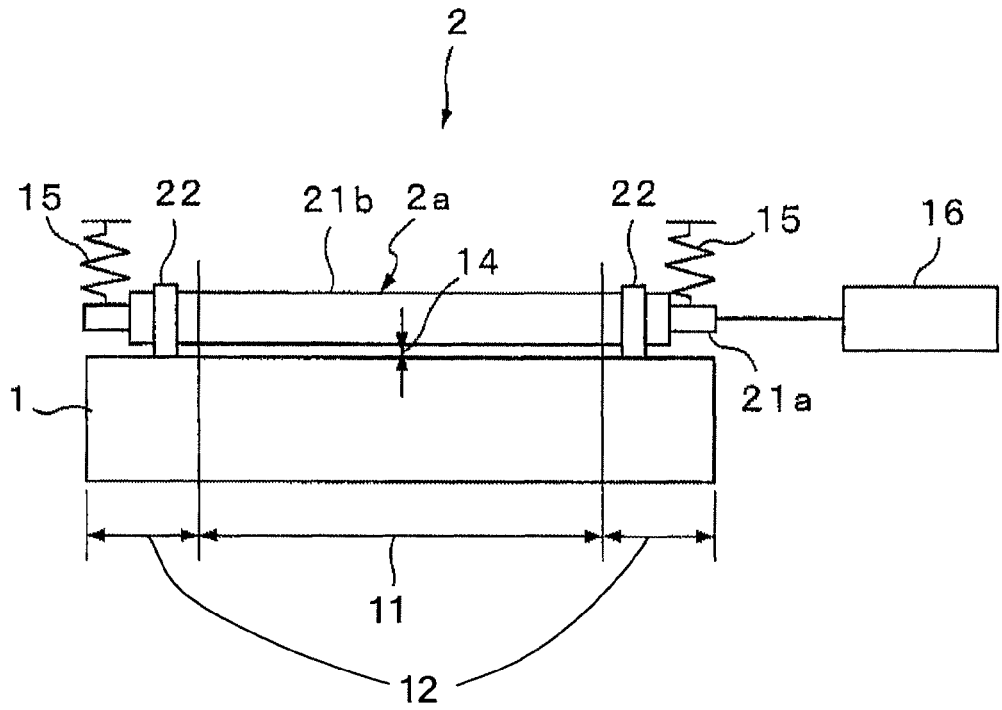
FIG. 3 is structural diagram showing a charging unit configured to charge a surface of an image bearing member.

FIG. 3 is an explanatory diagram of one example of the charging device 2.

The charge roller 2*a* is composed of a shaft 21*a* and a roller 21*b*. The roller 21*b* is rotatable by the rotation of the shaft 21*a*, and does not contact with the photoconductor 1 at a portion facing an image forming region 11 in which an image is to be formed, among the surface of the photoconductor 1.

The size of the charge roller 2*a* in a longitudinal direction (direction of the shaft) is set to be little longer than the size of image forming region 11. At both ends of the charge roller 2*a* in a longitudinal direction, spacers 22 are provided. The two spacers 22 are contacted with non-image forming regions 12 at both ends of the photoconductor surface to form a minute gap 14 between the photoconductor 1 and the charge roller 2*a*.

This minute gap 14 is set to maintain a distance of the closest portion between the charge roller 2*a* and the photoconductor 1 to be 5 μm to 100 μm. More preferably, the minute gap 14 is 30 μm to 65 μm, and is set to be 50 μm in the present embodiment. The shaft 21*a* is pressed against the photoconductor by a pressure spring 15.

Thus, the minute gap 14 can be precisely maintained. The charge roller 2*a* rotates along with the rotation of the photoconductor surface via the spacers 22.

The charge roller 2*a* is connected to a power source 16 for charging. The power source 16 enables to generate close-contact discharging in a minute gap between photoconductor surface and the surface of the charge roller to thereby charge photoconductor surface uniformly. As a voltage to be applied in the present embodiment, an alternating current voltage is used in which an AC voltage as an alternating current component is superimposed on a DC voltage as a direct current component.

When the alternating current voltage, in which an AC voltage is superimposed on a DC voltage, is applied to the charge roller 2*a*, the impact such as a variation of the charge potential due to a fluctuation of the minute gap is suppressed, so that uniform charging is effected.

The charge roller 2*a* has a cylindrical core bar as an electric conductive support, and a resistance regulating layer formed on the peripheral surface of the core bar. Preferably, the surface of the charge roller 2*a* is hard. Although a rubber member may be used for a roller member, the use of such easily deformable member makes it hard to maintain the minute gap 14 with a uniform distance between the photoconductor 1 and the roller, and only a central portion of the charge roller 2*a* unexpectedly contacts the photoconductor surface, depending on the image forming conditions.

It is difficult to prevent leak of the protecting agent and smear of the charging member, which are caused by a locational, unexpected contact between the charge roller 2*a* and the photoconductor surface. Thus, when a noncontact charging method is used, it is preferable to use a less-flexible and hard member.

Examples of the charge roller 2*a* having a hard surface include a charge roller whose resistance controlling layer is formed from a thermoplastic resin composition (polyethylene, polypropylene, polymethyl methacrylate, polystyrene and its copolymers, etc.) in which a polymer ion conductive agent is dispersed, the surface of the resistance controlling layer being subjected to a film-hardening treatment with a hardening agent.

The film-hardening treatment is performed, for example, by immersing the resistance controlling layer in a treatment solution containing an isocyanate-containing compound, but may also be performed by further forming a hardened film layer on the surface of the resistance controlling layer. In the present embodiment, the charge roller 2*a* was formed to have ϕ 12 mm (diameter: 12 mm).

The present embodiment has a discharge-deterioration prevention unit to prevent deterioration of the surface of a photoconductor due to close-contact discharging. The specific configuration thereof will be described below in detail. The term "deterioration" herein means deterioration of a photoconductor surface due to both acceleration of abrasion of the photoconductor surface and activation of the photoconductor surface, which are caused by discharging. In the present invention, both of the problems are solved by applying a protecting agent to a photoconductor surface.

As shown in FIG. 1, the image forming apparatus of the present embodiment includes a protecting agent coating device 30 as a protecting agent providing unit to provide a protecting agent 32 to the photoconductor surface. The protecting agent coating device 30 is provided with a fur brush 31, which is a coating member and is a brush roller, the protecting agent 32, and a pressure spring 33 for pressing the protecting agent 32 against the fur brush 31.

The protecting agent 32 is a solid protecting agent formed into a bar. The tip portion of the fur brush 31 is in contact with the photoconductor surface, and while rotating on the shaft, the fur brush 31 scrapes up some amount of the protecting agent 32, conveys the protecting agent 32 to the contact point with the photoconductor surface, and applies it onto the photoconductor surface.

In order to make the fur brush 31 continue to contact with the protecting agent 32, even when the amount of the protecting agent 32 is reduced with time by being scraped up by the fur brush 31, the protecting agent 32 is pressed against the fur brush 31 with a predetermined pressure by the pressure spring 33.

Thus, a small and uniform amount of the protecting agent 32 can be scraped up on a constant basis.

Examples of the protecting agent 32 include fatty acid metal salts such as lead oleate, zinc oleate, copper oleate, zinc stearate, cobalt stearate, iron stearate, copper stearate, zinc palmitate, copper palmitate, and zinc linoleate; and fluorine-based resins such as polytetrafluoroethylene, polychlorotrifluoroethylene, polyvinylidene fluoride, polytrifluorochloroethylene, dichlorodifluoroethylene, tetrafluoroethylene-ethylene copolymer, and tetrafluoroethylene-oxafluoropropylene copolymer.

Of these, metal stearate is preferable because it is highly effective in reducing a friction coefficient of the photoconductor 1, with zinc stearate being more preferable. Zinc stearate may be used solely, or fine particles thereof may be added to the protecting agent.

In the case where the protective layer is formed of the protecting agent for image bearing member (protecting agent 32) deteriorates due to the influence of electric stress, or the like, the use of fine particles as the protecting agent 32 is preferable because deteriorated components are moderately removed and formation of new protective layer is promoted. The number average particle diameter of the fine particles is preferably 0.1 μm to 3.0 μm because only the deteriorated protective layer components can be removed, without substantially causing abrasion scratches of the surface of the image bearing member.

The fine particle may be any of organic fine particles, inorganic fine particles, and complex fine particles, and may be appropriately selected depending on the purpose.

Examples thereof include inorganic fine particles such as silica, alumina, ceria, zirconia, clay, talc, calcium carbonate, and surface-hydrophobicity treated fine particles thereof; and organic fine particles such as polymethyl methacrylate fine particles, polystyrene fine particles, silicone fine particles, and α-olefin-norbornene copolymer resin fine particles.

As mentioned above, in the present invention (present embodiment), which is presented on the basis of the fact that a powdery protecting agent is transferred onto a charging member by the effect of an electric field, a protecting agent charging member 9 is disposed between the protecting agent coating device 30 and the charge roller 2*a* to solve the above-mentioned problem. The charging member herein means a member which charges a photoconductor surface by externally applying a voltage.

In the present embodiment, a conductive elastic blade as the protecting agent charging member 9 is contacted with the photoconductor 1, and a direct-current voltage of −800 V is applied as an electric field from a power source (not shown), to the photoconductor surface. The power source and the protecting agent charging member 9 constitute the protecting agent charging unit.

The transfer of the powdery protecting agent, which has been applied onto the photoconductor surface 1, to the charge roller 2*a* due to the effect of an electric field is blocked by actively charging the powdery protecting agent so as to be charged with a certain polarity (the same polarity as that of the photoconductor) and utilize a repulsive force of the same polarity.

In view of this purpose, the protecting agent charging member 9 is preferably disposed near the protecting agent coating device 30.

The chargeability of the powdery protecting agent varies depending on the voltage applied. The use of an alternating current voltage in which an AC voltage is superimposed on a DC voltage is suitable for uniformly charging the powdery protecting agent.

However, application of an excessively high voltage may cause discharging, uneven charging of the powdery protecting agent, and may cause deterioration of the photoconductor. So, as a voltage to be applied to the conductive blade, it is preferable to use a direct current component of −50 V to −1,300 V, more preferably of −100 V to −1,100 V.

The elastic blade (the protecting agent charging member 9) has a function of spreading a powdery protecting agent to thereby the protecting agent can be efficiently formed into a film on the photoconductor. Accordingly, this configuration can reduce the amount of the powdery protecting agent, and so smear of the charge roller 2*a* can be further reduced.

By reducing the amount of the protecting agent passing through a cleaning blade, the charging of the protecting agent becomes easier, and the reduction of smear of the charge roller 2*a* becomes easier.

In brief, the blade shape of the protecting agent charging member 9 brings about two effects; that is, the transfer of the protecting agent to the charge roller 2*a* due to the charging is suppressed, and the amount of the protecting agent passing through a cleaning blade is suppressed to thereby increase the uniform chargeability of the protecting agent.

A material of the elastic blade is not particularly limited and may be selected from conventionally known elastic materials for cleaning blade, such as urethane rubber, a hydrin rubber, a silicone rubber, and a fluorine rubber. Of these, urethane rubber is preferable. The conductivity can be provided by the addition of a carbon such as carbon black and acetylene black, and a conductive oxide such as zinc oxide and magnetite. A rubber material having high conductivity may also be used.

The blade is fixed to a blade support by any arbitrary method, including bonding or fusion, such that the tip portion thereof can be press-contacted with the surface of the image bearing member. As for the thickness of the blade, it is not simply defined and it depends on the pressure to be applied thereto, but it is preferably about 0.5 mm to 5 mm, more preferably 1 mm to 3 mm.

As for the length (so called free length) of the blade, it is also not simply defined and it depends on the pressure to be applied thereto, but it is preferably about 1 mm to 15 mm, more preferably 2 mm to 10 mm.

In other aspect of the protecting agent charging member 9, a layer of resin, rubber, elastomer or the like is formed by coating or dipping on the elastic metal blade surface such as a spring panel surface, as necessary via a coupling agent or a primer component. If needed, the surface may further be subjected to thermosetting treatment, or further be subjected to surface polishing, or the like.

The thickness of the elastic metal blade is preferably about 0.05 mm to 3 mm, more preferably about 0.1 mm to 1 mm.

After mounted, the elastic metal blade may be subjected to a bending treatment so that the blade is set in substantially parallel to the support shaft, in order to avoid distortion of the blade.

The image bearing member is sufficiently pressed by the protecting agent coating device 30 with a pressing force by which the protecting agent is spread to form a protective layer or a protective film on a surface of the image bearing member. The pressure, as a line pressure, is preferably 5 gf/cm to 80 gf/cm, more preferably 10 gf/cm to 60 gf/cm.

The conductive blade (the protecting agent charging member 9) is brought into contact with the image bearing member preferably in a counter mode rather than in a trailing mode, because in a counter mode, the amount of the powdery protecting agent passing through the cleaning blade can be reduced as compared to the trailing mode.

EXAMPLES

Example 1

As an evaluation apparatus, a remodeled image forming apparatus of a color complex machine IMAGIO MPC 4500 (manufactured by Ricoh Company Ltd.), in which the black station had been remodeled, was used. As a charging member, a hard resin roller having a diameter of 12 mm was used, and a gap between the charging member and the photoconductor was adjusted to 50 μm.

As the charge condition, an alternating electric field in which a sinusoidal wave having Vpp of 2.2 kV and a frequency of 1.5 kHz, as an AC component, was superimposed on a DC component having −600 V, was applied to a photoconductor surface.

A zinc stearate bar as a protecting agent was brought into contact with a cleaning brush so as to supply the photoconductor surface with zinc stearate by the brush.

A conductive blade as a protecting agent charging member was disposed, in a trailing mode, at a position downstream of the cleaning brush and a zinc stearate coating brush and upstream of the charge roller. To this protecting agent charging blade, a DC voltage of −800 V was applied.

The photoconductor produced as mentioned above was mounted to the remodeled evaluation apparatus, and running of 50,000 sheets was performed. If a black streak appeared on an image during the running, the number of output sheets was counted until a black streak occurred. If no black streak was observed, the surface of the charge roller after the running was read by a scanner, thereby measuring the average brightness of the charge roller.

Example 2

Evaluation was carried out in the same manner as in Example 1 except that the conductive blade as a protecting agent charging member was disposed in a counter mode.

Comparative Example 1

Evaluation was made in the same manner as in Example 1 except that no voltage was applied to the protecting agent charging member.

Comparative Example 2

Evaluation was carried out in the same manner as in Example 2 except that no voltage was applied to the protecting agent charging member.

The results of Examples 1 and 2, and Comparative Examples 1 and 2 are shown in Table 1.

TABLE 1

| | When black streak appeared (sheet) | Average brightness of charge roller after running of 50,000 sheets |
|---|---|---|
| Example 1 | Not found | 45 |
| Example 2 | Not found | 38 |
| Comp. Ex. 1 | 30,000 th | No data |
| Comp. Ex. 2 | 40,000 th | No data |

As is apparent from Table 1, in Examples 1 and 2, since the protecting agent charging member was disposed between the protecting agent coating device and the charging member (charge roller), the charging member had no smear on its surface and it was possible to obtain an excellent image having no black streaks over a long period of time. In the Comparative Examples 1 and 2, by contrast, smear appeared on the charging member in the early stage of the running test.

What is claimed is:

1. An image forming apparatus comprising:

a charging unit configured to charge a surface of an image bearing member utilizing discharge generated by applying a voltage containing an alternating current component to a charging member disposed in contact with or close to the image bearing member, so that a latent electrostatic image is formed on the image bearing member, a developing unit configured to develop the latent electrostatic image formed on the image bearing member using a toner, a cleaning unit configured to clean the surface of the image bearing member using a blade, a protecting agent applying unit configured to rub and scrape a protecting agent by a brush roller and apply the protecting agent to the surface of the image bearing member, and a protecting agent charging member configured to charge the protecting agent, the protecting agent charging member being disposed between the protecting agent applying unit and the charging unit, wherein the protecting agent charging member is a conductive blade.

2. The image forming apparatus according to claim 1, wherein the conductive blade is made of an elastic member.

3. The image forming apparatus according to claim 1, wherein the conductive blade is contacted with the image bearing member in a direction counter to the rotational direction of the image bearing member.

4. The image forming apparatus according to claim 1, wherein the protecting agent comprises a fatty acid metal salt.

5. The image forming apparatus according to claim 4, wherein the fatty acid metal salt is zinc stearate.

6. A process cartridge detachably mounted on a main body of an image forming apparatus, the process cartridge comprising as an integral unit:

a charging unit configured to charge a surface of an image bearing member utilizing discharge generated by applying a voltage containing an alternating current component to a charging member disposed in contact with or close to the image bearing member, so that a latent electrostatic image is formed on the image bearing member, a developing unit configured to develop the latent electrostatic image formed on the image bearing member using a toner, a cleaning unit configured to clean the surface of the image bearing member using a blade, a protecting agent applying unit configured to rub and scrape a protecting agent by a brush roller and apply the protecting agent to the surface of the image bearing member, and a protecting agent charging member configured to charge the protecting agent, the protecting agent charging member being disposed between the protecting agent applying unit and the charging unit, wherein the protecting agent charging member is a conductive blade.

* * * * *